US011009900B2

(12) United States Patent
Ivanov et al.

(10) Patent No.: US 11,009,900 B2
(45) Date of Patent: May 18, 2021

(54) METHOD AND CIRCUITRY FOR COMPENSATING LOW DROPOUT REGULATORS

(71) Applicant: Texas Instruments Incorporated, Dallas, TX (US)

(72) Inventors: Vadim Valerievich Ivanov, Tucson, AZ (US); Sahana Sriraj, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 243 days.

(21) Appl. No.: 15/400,976

(22) Filed: Jan. 7, 2017

(65) Prior Publication Data

US 2018/0196454 A1 Jul. 12, 2018

(51) Int. Cl.
*G05F 1/575* (2006.01)

(52) U.S. Cl.
CPC ..... *G05F 1/575* (2013.01)

(58) Field of Classification Search
CPC ..... G05F 1/563; G05F 1/565; G05F 1/569; G05F 1/575; H03F 3/45071; H03F 3/45183; H03F 2200/234; H03F 2203/45652
See application file for complete search history.

(56) References Cited

U.S. PATENT DOCUMENTS 6,246,221 B1 * 6/2001 Xi ..... G05F 1/575 323/280
6,369,618 B1 4/2002 Bloodworth et al.
6,703,815 B2 3/2004 Biagi
7,253,595 B2 8/2007 Oddoart et al.
2002/0057125 A1 * 5/2002 Demizu ..... H02M 3/156 327/538
2004/0061554 A1 4/2004 Kajiwara et al.
2004/0178778 A1 * 9/2004 Bansal ..... G05F 1/575 323/274

(Continued)

FOREIGN PATENT DOCUMENTS

CN 104777871 A 7/2015
CN 104821721 A 8/2015
CN 104950974 A 9/2015

OTHER PUBLICATIONS

Notification of Transmittal of the International Search Report and the Written Opinion of the International Searching Authority, or the Declaration; dated Apr. 26, 2018, 7 pages.

(Continued)

*Primary Examiner* — Matthew V Nguyen
(74) *Attorney, Agent, or Firm* — Mark Allen Valetti; Charles A. Brill; Frank D. Cimino

(57) ABSTRACT

Low dropout regulators (LDOs) are disclosed herein. An example of an LDO includes an error amplifier having a first input and a second input, wherein the first input is for coupling to an output of the LDO and the second input for coupling to a reference voltage. The error amplifier has an output with a voltage that is proportional to the difference between the output voltage and the reference voltage. A second amplifier is coupled between the error amplifier and the output of the LDO. A gain boost amplifier is coupled between the error amplifier and the second amplifier. The gain boost amplifier increases DC gain of the LDO in response to a load step on the output.

16 Claims, 5 Drawing Sheets

(56) References Cited

U.S. PATENT DOCUMENTS

| | | | | |
|---|---|---|---|---|
| 2005/0248394 | A1* | 11/2005 | Lou | H03H 11/04 327/551 |
| 2006/0038610 | A1* | 2/2006 | Gudem | H03H 11/1234 327/552 |
| 2007/0018621 | A1* | 1/2007 | Mok | G05F 1/575 323/280 |
| 2008/0218139 | A1* | 9/2008 | Takagi | G05F 1/575 323/280 |
| 2009/0322429 | A1* | 12/2009 | Ivanov | H03F 3/45179 330/257 |
| 2011/0101936 | A1* | 5/2011 | Wang | G05F 1/56 323/280 |
| 2011/0260789 | A1* | 10/2011 | Kawashima | G11B 7/13 330/86 |
| 2012/0212199 | A1 | 8/2012 | Amer et al. | |
| 2015/0015222 | A1* | 1/2015 | Ivanov | G05F 1/56 323/273 |
| 2015/0177760 | A1* | 6/2015 | Ozanoglu | G05F 1/575 323/273 |
| 2015/0198959 | A1* | 7/2015 | Kuttner | G05F 1/575 323/273 |
| 2017/0003699 | A1* | 1/2017 | Lin | G05F 1/575 |
| 2018/0120882 | A1* | 5/2018 | Zhang | G05F 1/56 |

OTHER PUBLICATIONS

Search Report for Application No. 2018800141383, dated Apr. 13, 2020.
EU Search Report for Application No. 18736064.9-1205/3566108, dated Dec. 15, 2020.

* cited by examiner

METHOD AND CIRCUITRY FOR COMPENSATING LOW DROPOUT REGULATORS

BACKGROUND

Power management is an issue for circuits having several power supplies, especially when the circuits and power supplies are located on a single chip, such as a system-on-chip (SoC) circuit. Some of these circuits are powered by one or more DC-to-DC converters, which are followed by numerous low dropout regulators (LDOs), wherein each LDO is associated with a power domain. It is not uncommon to have multiple power domains on a single SoC circuit. These power domains may include digital signal processing cores, several banks of memory circuits, analog units, Bluetooth radio, and audio units.

A load step on an LDO occurs when the load powered by an LDO changes. Maintaining the accuracy of voltages output by LDOs during load step conditions from no load to full load is important for proper operation of the power domains. One method of maintaining accuracy during a load step is by the inclusion of an external load capacitor coupled to each LDO. With so many LDOs on each circuit and the circuits becoming smaller, the use of an external load capacitor for each of the LDOs is not practical because of the size and costs of the external capacitors.

SUMMARY

Low dropout regulators (LDOs) are disclosed herein. An example of an LDO includes an error amplifier having a first input and a second input, wherein the first input is for coupling to an output of the LDO and the second input for coupling to a reference voltage. The error amplifier has an output with a voltage that is proportional to the difference between the output voltage and the reference voltage. A second amplifier is coupled between the error amplifier and the output of the LDO. A gain boost amplifier is coupled between the error amplifier and the second amplifier. The gain boost amplifier increases DC gain of the LDO in response to a load step on the output.

DETAILED DESCRIPTION

Figure 1:
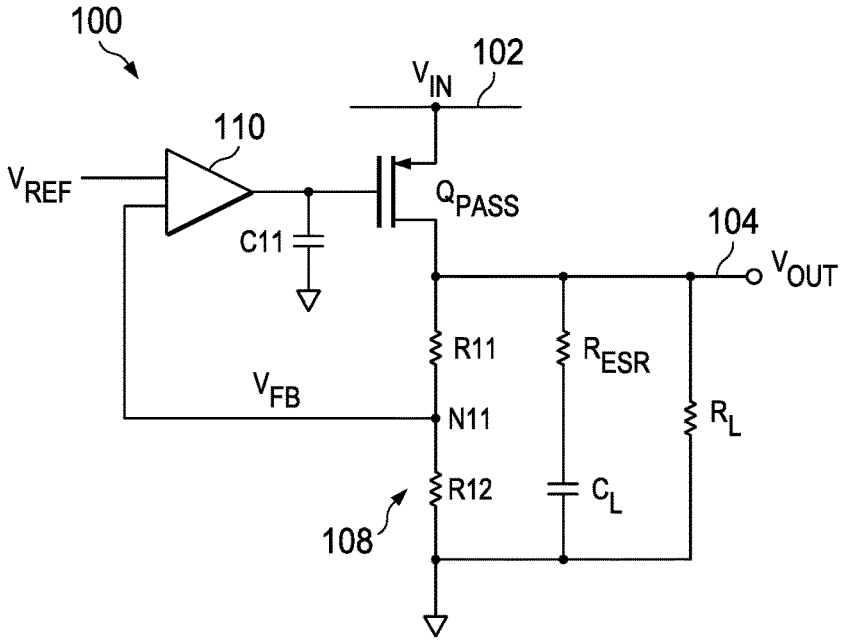
FIG. 1 (PRIOR ART)
FIG. 1 is a schematic diagram of a low dropout regulator (LDO).

Example embodiments are described with reference to the drawings, wherein like reference numerals are used to designate similar or equivalent elements. Illustrated ordering of acts or events should not be considered as limiting, as some acts or events may occur in different order and/or concurrently with other acts or events. Furthermore, some illustrated acts or events may not be required to implement a methodology in accordance with this disclosure.

As circuits become more integrated, they have many different devices, components, and subcircuits that often operate independent of each other or at least partially independent of each other. As used herein, the term circuit can include a collection of active and/or passive elements that perform a circuit function such as an analog circuit or control circuit. The term circuit can also include an integrated circuit where all the circuit elements are fabricated on a common substrate. These different systems typically require their own power source or power domain, with many systems requiring a plurality of power domains. Examples of these different systems include processors, memory devices, radio transmitters and receivers, and audio units. A circuit, such as an integrated circuit, may have several of these systems and may have inputs for only one or two input voltages. These input voltages are coupled to DC-to-DC converters that provide power to a plurality of low dropout regulators (LDOs), wherein each LDO provides power to each of the systems. It is not uncommon to have as many as fifty LDOs in a single circuit.

An LDO converts and regulates a high input voltage to a lower output voltage. A dropout voltage is the amount of headroom required to maintain a regulated output voltage. Accordingly, the dropout voltage is the minimum voltage difference between the input voltage and the output voltage required to maintain regulation of the output voltage. The input voltage minus the voltage drop across a pass element within the LDO equals the output voltage. For example, a 3.3V regulator that has 1.0V of dropout requires the input voltage to be at least 4.3V. Another typical application involving LDOs is for generating 3.3V from a 3.6V Li-Ion battery, which requires a much lower dropout voltage of less than 300 mV.

FIG. 1 is a schematic diagram of an LDO 100. The LDO 100 has an input 102 that receives an input voltage $V_{IN}$ at the input 102 during operation of the LDO 100. An output 104 provides an output voltage $V_{OUT}$ present during operation of the LDO 100. A pass transistor $Q_{PASS}$ is coupled between the input 102 and the output 104. A pass voltage across the pass transistor $Q_{PASS}$ is the difference between the input voltage $V_{IN}$ and the output voltage $V_{OUT}$. The minimum pass voltage for sustaining the operation of the LDO 100 is the dropout voltage.

A voltage divider 108 consisting of resistors R11 and R12 is coupled between the output 104 and a common node, which in the example of FIG. 1 is a ground node. A node N11 is located between resistors R11 and R12 and has a feedback voltage $V_{FB}$ present during operation of the LDO 100. A load capacitor $C_L$ is coupled between the output 104 and the ground node. The equivalent series resistance (ESR) of the load capacitor $C_L$ is depicted as resistor $R_{ESR}$. A load resistance $R_L$ is also coupled between the output 104 and the ground node.

The gate of the pass transistor $Q_{PASS}$ is coupled to a pass capacitor C11 and the output of a differential amplifier 110. The differential amplifier 110 has a first input coupled to a reference voltage $V_{REF}$ and a second input coupled to node N11, which has the feedback voltage $V_{FB}$ present during operation of the LDO 100. The output of the differential amplifier 110 is proportional to the difference between the reference voltage $V_{REF}$ and the feedback voltage $V_{FB}$ and serves to drive the gate of the pass transistor $Q_{PASS}$. If the feedback voltage $V_{FB}$ is less than the reference voltage $V_{REF}$, the differential amplifier 110 drives the gate of the pass transistor $Q_{PASS}$ harder to increase the output voltage $V_{OUT}$. Likewise, if the feedback voltage $V_{FB}$ is greater than the reference voltage $V_{REF}$, the differential amplifier 110 reduces the drive on the gate of the pass transistor $Q_{PASS}$, which lowers the output voltage $V_{OUT}$.

Conventional LDOs, such as the LDO 100, require some minimum load capacitance $C_L$ and/or minimal ESR, noted as resistor $R_{ESR}$, for stability/compensation. For example, when the LDO 100 undergoes a load step, meaning that a load coupled to the output 104 of the LDO 100 changes, transients with significant settling times can be generated. The trend with conventional LDOs is for lower quiescent current, such as quiescent currents limited to less than ten percent of the maximum load current. The maximum load current is the maximum current that may pass through the pass transistor $Q_{PASS}$. These low quiescent currents, along with other factors, cause the transient reaction time during a load step to be in the microsecond range, which is not acceptable in many applications. Larger load capacitance in the load capacitor $C_L$ reduces the transient settling time by improving the compensation of the LDO 100. However, due to limitations in silicon die area, on-chip load capacitors have low capacitance and result in longer transient settling times, which is not acceptable in many applications. Resolving this transient problem requires the use of bulky, off-chip load capacitors which increase board area and component count of the circuit in which the LDO 100 is located. Some LDOs have been developed that can operate with or without a load capacitance and have extremely fast reaction time in response to load steps. However, these fast responding LDOs have low gain for stability purposes, which has the drawback of low accuracy in their output voltages. Increasing the gain of these LDOs increases the accuracy of the output voltage, but it has the drawback of decreasing the stability, which leads to stability problems during load steps.

The LDOs described herein provide stability by way of compensation under load step conditions with high gain, which yields high accuracy. The high gain and stability is achieved without the addition of load or compensation capacitors. The LDOs provide different gains depending on the difference between the input and output voltages. A gain boost amplifier nested within the LDO serves to increase the DC accuracy of the LDO after the load step. Several different circuit schematic diagrams are described herein as examples of the LDOs. These schematic diagrams are not limiting in that variations of the circuits by those skilled in the art may perform the functions of the LDOs described herein.

Figure 2:
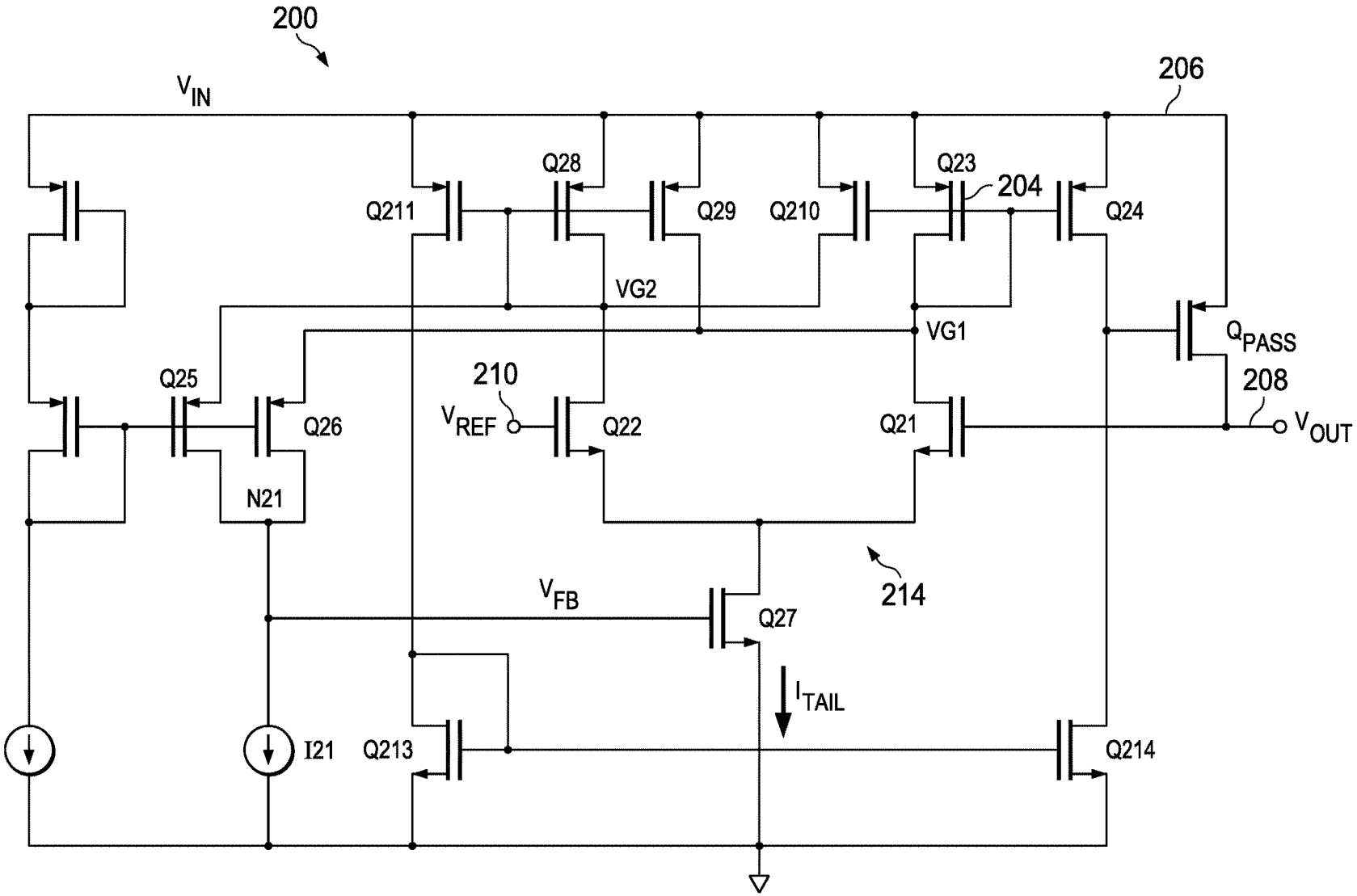
FIG. 2 is a schematic diagram of an LDO with a class AB input stage and without compensation.

FIG. 2 is a schematic diagram of an LDO 200 with a class AB input stage 204 and without compensation. The LDO 200 is an example of circuitry that may be coupled to the compensation circuits described herein. The LDO 200 has an input 206 that is coupled to an input voltage $V_{IN}$ during operation of the LDO 200. The LDO 200 generates and regulates an output voltage $V_{OUT}$ at an output 208 during operation of the LDO 200. A reference input 210 is coupled to a reference voltage $V_{REF}$ that is present during operation of the LDO 200. An error voltage $V_E$ (not shown in FIG. 2) is the difference between the reference voltage $V_{REF}$ and the output voltage $V_{OUT}$. Transistors Q21 and Q22 form the input of an error amplifier 214 with the gate of transistor Q22 being coupled to the reference voltage $V_{REF}$ and the gate of transistor Q21 being coupled to the output 208. In some examples, the output voltage $V_{OUT}$ is coupled to the error amplifier 214 by way of a voltage divider (not shown), so the voltage received by the error amplifier 214 is proportional to the output voltage $V_{OUT}$, but not equal to the output voltage $V_{OUT}$. The error amplifier 214 has high input impedances as seen by the reference voltage $V_{REF}$ and the output voltage $V_{OUT}$. The output of the error amplifier 214 is a differential voltage on the drains of transistors Q21 and Q22. The voltages on the drains of transistors Q21 and Q22 are referred to individually as VG1 and VG2. The gate of the pass transistor $Q_{PASS}$ is driven by the output of the error amplifier 214 by way of transistors Q23 and Q24 that form a portion of a second amplifier.

The outputs of the error amplifier 214 are coupled to the sources of transistors Q25 and Q26 that form a common gate amplifier. Accordingly, the voltages VG1 and VG2 are present at the sources of transistors Q25 and Q26 during operation of the LDO 200. The drains of transistors Q25 and Q26 are coupled to a node N21, which is coupled to a current source I21. Node N21 is also coupled to the gate of a transistor Q27, wherein the drain of transistor Q27 is coupled to the sources of transistors Q21 and Q22 in the error amplifier 214. The voltage on node N21 and the gate of transistor Q27 is a feedback voltage $V_{FB}$. The source of transistor Q27 is coupled to a node, such as ground as shown in FIG. 2. The current flowing through transistor Q27 is the tail current $I_{TAIL}$ of the error amplifier 214. As used herein the term tail current $I_{TAIL}$ refers to the combined currents in the source terminals of the differential pair of transistors Q21 and Q22 in the error amplifier 214. Transistors Q23, Q24, Q28, and Q211 are symmetric current mirror loads for the LDO 200. Transistors Q213 and Q214 serve as current mirrors for transistors Q211 and Q24.

The gate of the pass transistor $Q_{PASS}$ is driven by the output of the error amplifier 214 by way of transistor Q24, which serves as a portion of a second amplifier described herein. A voltage at the gate of the pass transistor $Q_{PASS}$ changes the source-to-drain resistance of the pass transistor $Q_{PASS}$. Transient conditions, such as those resulting from load steps on the output 208, are detected by monitoring the error voltage $V_E$, which is the difference between the reference voltage $V_{REF}$ and output voltage $V_{OUT}$. When the error voltage $V_E$ is negligible, the voltages VG1 and VG2 are substantially the same, which causes the current through transistors Q25 and Q26 to be substantially the same. Accordingly, the current through each of transistors Q25 and Q26 is half of the current generated by the current source I21. This sets the currents through the transistors Q21 and Q22 in the error amplifier 214 to be substantially equal. The error amplifier 214 operates in a quiescent state in these conditions. The voltages VG1 and VG2 set the currents in the error amplifier 214 by setting input stage currents.

When the error voltage $V_E$ rises, the voltages VG1 and VG2 differ. When the error voltage $V_E$ is greater than a predetermined value, the smaller voltage of VG1 and VG2 triggers a higher current in the corresponding transistors Q25 and Q26, which forces the feedback voltage $V_{FB}$ to increase. As a result, the error amplifier 214 leaves its quiescent state. This increase in the feedback voltage $V_{FB}$ increases the tail current $I_{TAIL}$ flowing through transistor Q27 in proportion to the error voltage $V_E$. Thus, the tail current $I_{TAIL}$ in the error amplifier 214 increases in proportion to the error voltage $V_E$, which provides for fast transient response. More specifically, this change in tail current $I_{TAIL}$ results in higher current drive in the input stage to move the gate of the pass transistor $Q_{PASS}$ faster during the load step, so as to minimize transients during the load step. Nonlinearity in the LDO 200 is provided by the combination of transistors Q28/Q29 and Q23/Q210 during these conditions. In some examples where there is a ratio of four in the transistors, there is 1000× tail current increase for an error voltage $V_E$ of 100 mV.

Figure 3:
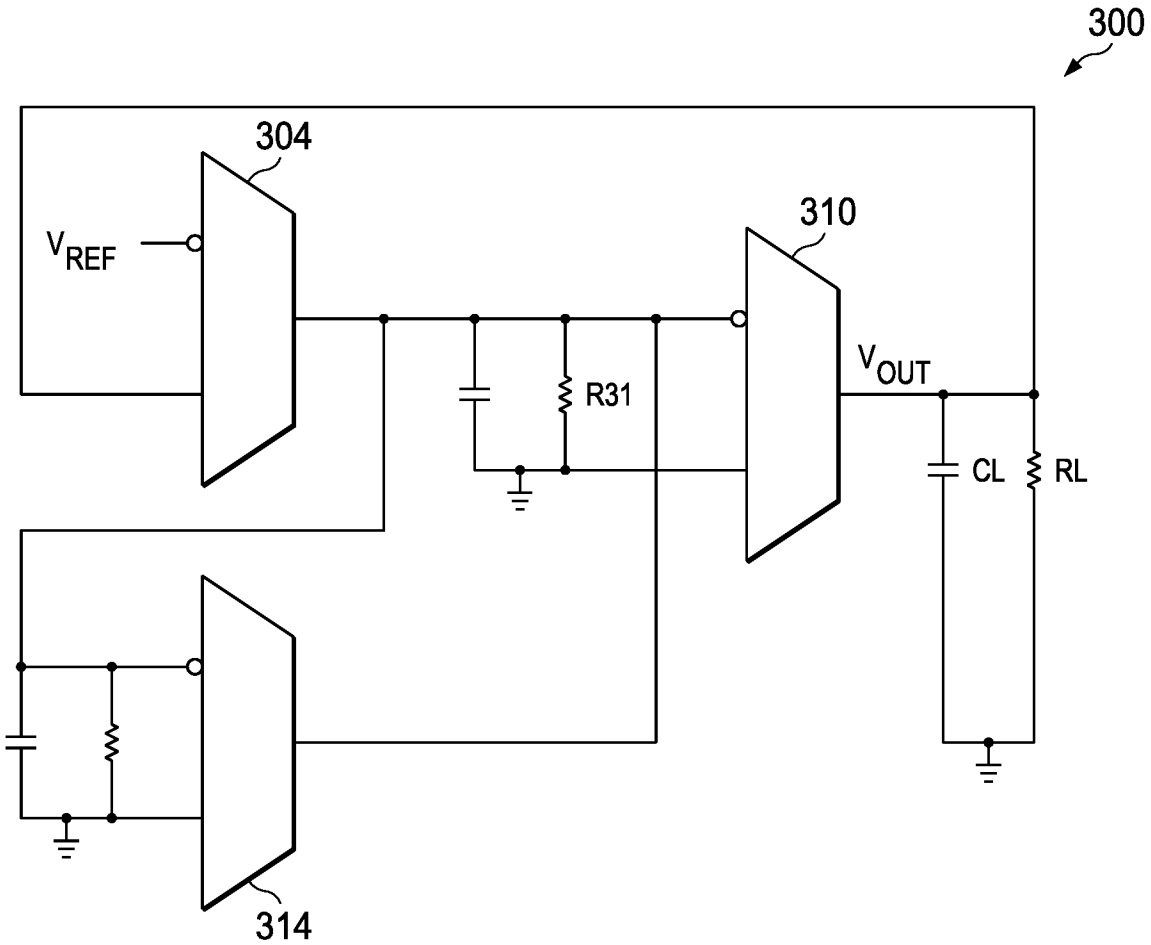
FIG. 3 is a block diagram of an example LDO that has compensation.

FIG. 3 is a block diagram of an LDO 300 that has compensation nested therein. The block diagram of the LDO 300 includes passive components that may or may not be included in a final circuit of the LDO 300. Some of the passive components shown in FIG. 3 are representative of the input and output impedances of the amplifiers in the LDO 300. The LDO 300 has an amplifier 304 that includes the input stage 204 of the error amplifier 214 of FIG. 2. A second amplifier 310 includes the pass transistor $Q_{PASS}$ (not shown) and the associated components. The combination of the amplifiers 304 and 310 constitutes the LDO 200 of FIG. 2. Compensation is achieved by reducing the voltage gain of the input stage 204, depicted as the amplifier 304, by limiting the resistance of a resistor R31 as described herein. In some examples, the resistance R31 is the resistance coupled to the gate of the pass transistor $Q_{PASS}$. Limiting the resistance of resistor R31 reduces the overall gain of the LDO 300, which results in low DC accuracy, but stabilizes the LDO 300. Recuperating the voltage gain of the LDO 300 includes nesting of the stages and boosting the gain of an existing, already stable, amplifier, such as the error amplifier 214 described above. Nesting of the amplifier stages is performed with the LDO 300 rather than cascading gain stages in series as is done in conventional applications. The nesting of the amplifiers in the LDO 300 is performed by a gain boost amplifier 314, which recuperates the gain for DC accuracy. The amplifier 314 tracks the voltage at its inputs and ensures that the voltage $V_{OUT}$ is equal to the voltage $V_{REF}$ to achieve DC accuracy.

Figure 4:
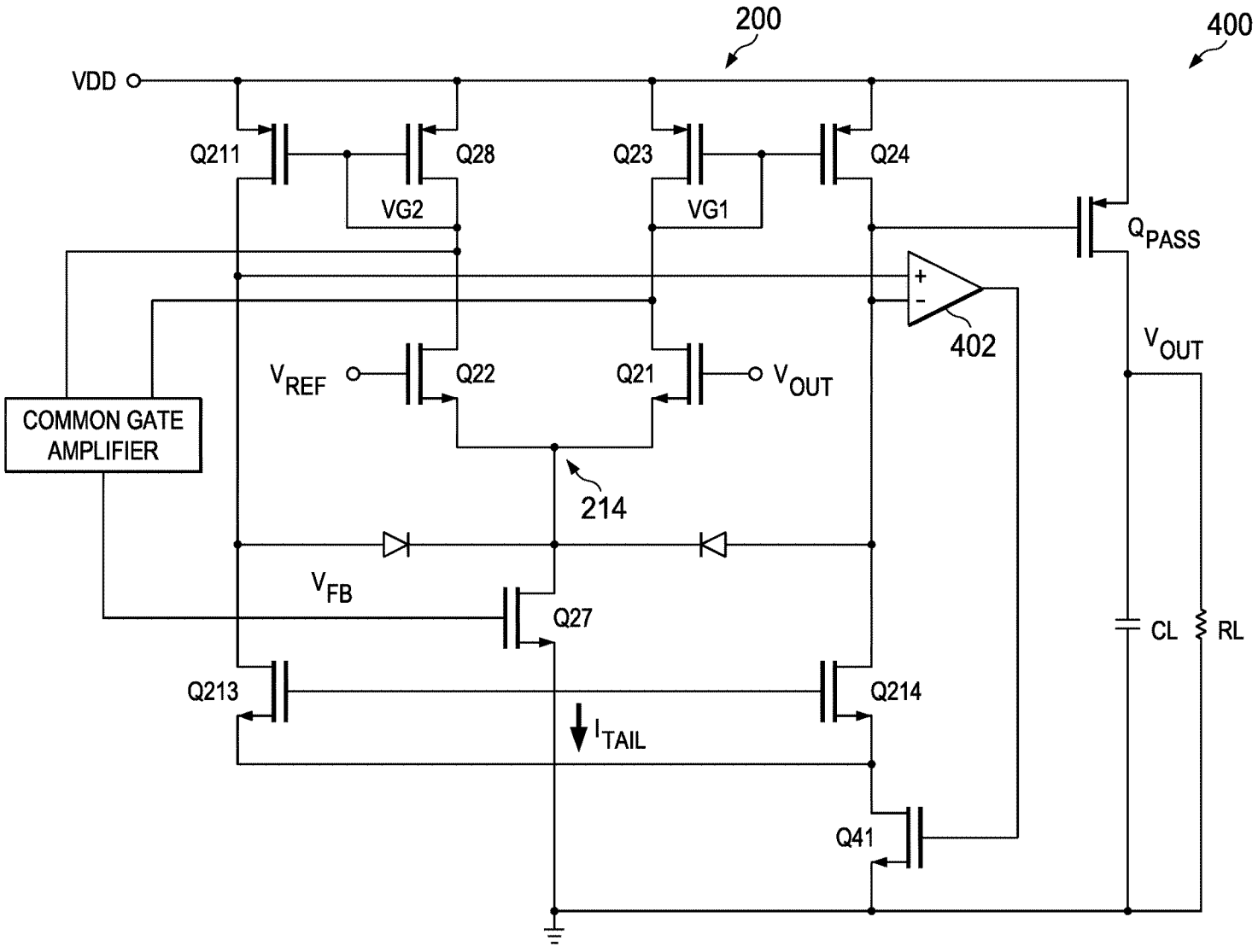
FIG. 4 is a schematic diagram of an example LDO having a gain boost amplifier nested therein.

FIG. 4 is a schematic diagram of an LDO 400 having a gain boost amplifier nested therein. The LDO 400 has many of the same components as the LDO 200 of FIG. 2 and has the same reference numerals applied to those components. The LDO 400 includes a gain boost amplifier 402 having an output coupled to the gate of a transistor Q41. Transistor Q41 is coupled between the sources of transistors Q213 and Q214 and the ground node. Accordingly, the current flow through transistors Q213 and Q214 is based on the output of the amplifier 402. The inputs of the amplifier 402 are coupled to the gate of transistor Q213 and the drain of transistor Q214, which is coupled to the gate of the pass transistor $Q_{PASS}$. The gain boost amplifier 402 is a tracking amplifier that ensures its inputs always track each other. More specifically, the gain boost amplifier 402 ensures that the voltage at the gate of transistor Q213 and the voltage at the gate of the pass transistor $Q_{PASS}$ track each other. The tracking is achieved by regulating the drain current of transistor Q41, which is achieved by the drive provided to the gate of transistor Q41 by the output of the amplifier 402.

Figure 5:
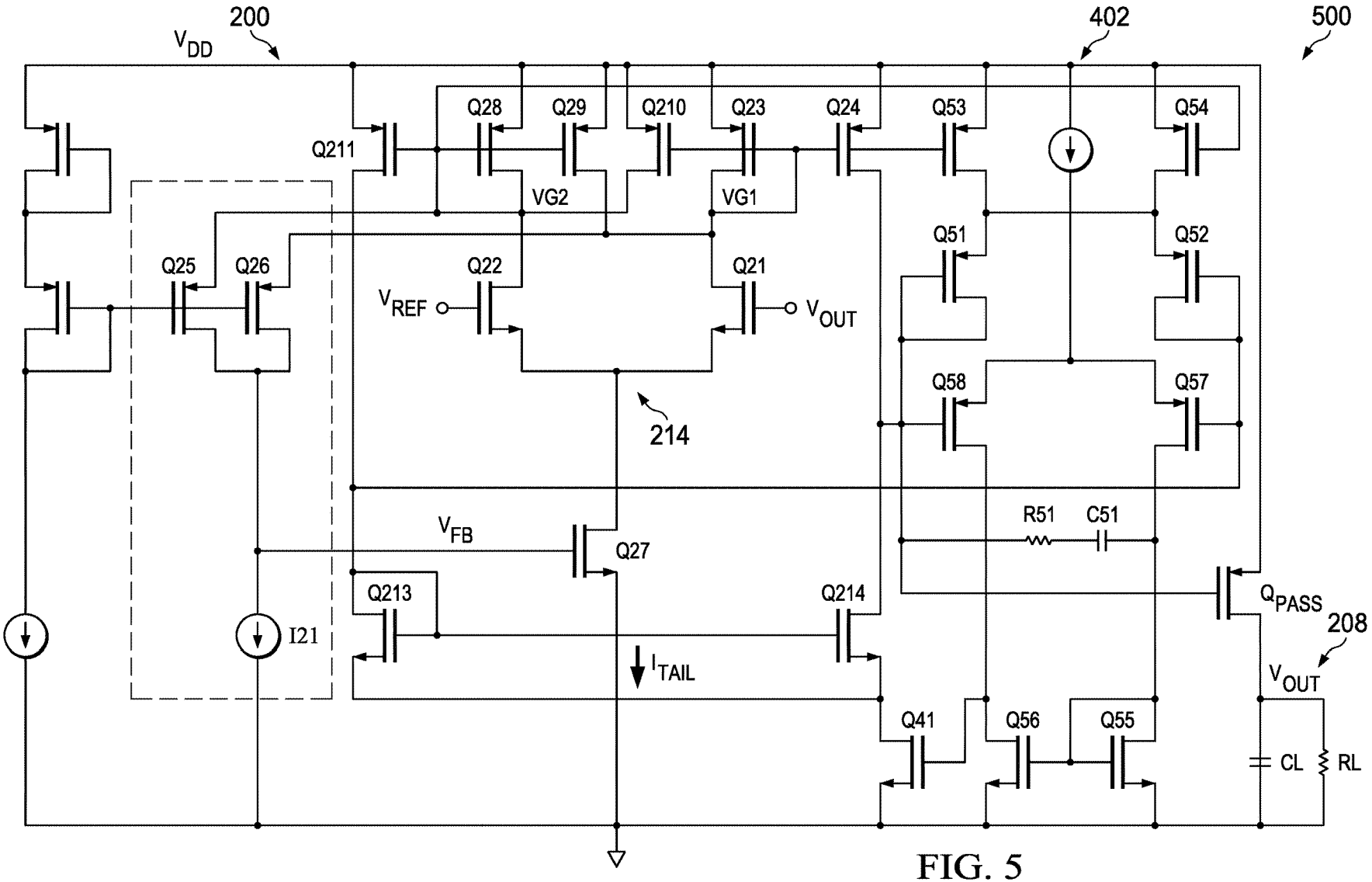
FIG. 5 is a detailed schematic diagram of an example LDO with a gain boost amplifier nested therein.

FIG. 5 is a schematic diagram of an example LDO 500 with the gain boost amplifier 402 nested therein. The LDO 500 includes the LDO 200 of FIG. 2 with the addition of the gain boost amplifier 402 of FIG. 4 that provides compensation and load stability. The LDO 500 includes substantially the same circuitry as the LDO 200 of FIG. 2 with the addition of the gain boost amplifier 402. Compensation in the LDO 500 is achieved by limiting the voltage gain of the error amplifier 214, which is accomplished by limiting the resistance at the gate of the pass transistor $Q_{PASS}$.

As shown in FIG. 5, transistors Q51 and Q52 are biased by a fraction of the currents through transistors Q53 and Q54, which achieves the lower voltage gain in the error amplifier 214. If the voltage gain in the error amplifier 214 is small, the overall gain of the LDO 500 may not be sufficient for acceptable load regulation. Transistors Q41 and Q55-Q58 form the gain boosting amplifier. With this gain boosting amplifier, the voltages at the gates of the pass transistor $Q_{PASS}$ and transistor Q213 track each other.

In some examples, the gain boosting amplifier 402 is designed to be slowed by the use of resistor R51 and capacitor C51 so that it does not affect the stability of the LDO 500. For example, resistor R51 and capacitor C51 form a filter that slows the amplifier 402. In some examples, the filter is not included in the LDO 500.

Figure 6:
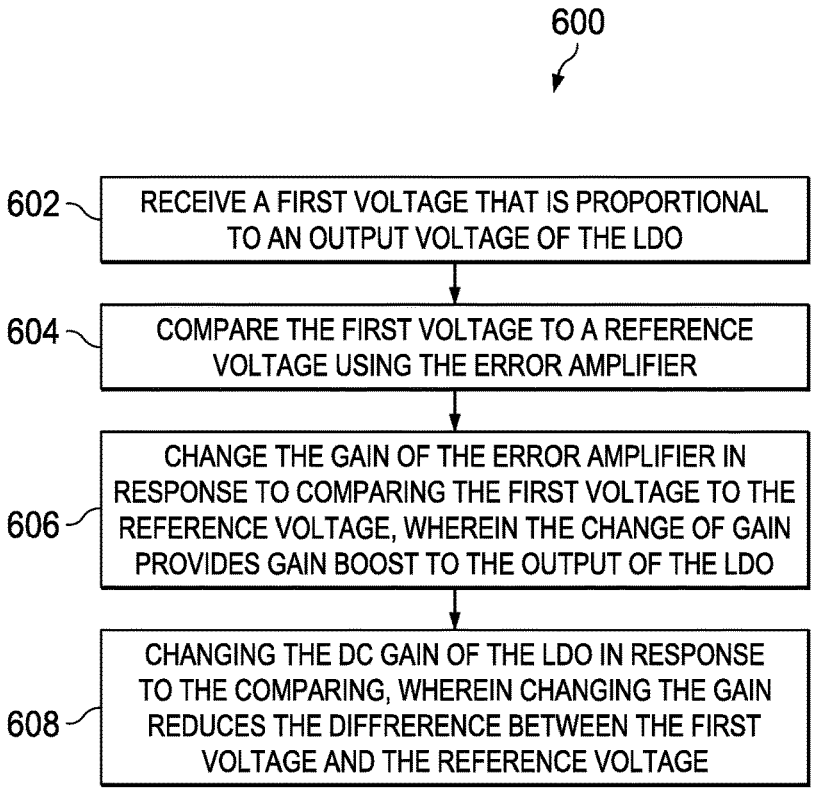
FIG. 6 is a flowchart describing a method of compensating a LDO wherein the LDO has an error amplifier coupled to a second amplifier.

FIG. 6 is a flowchart 600 describing a method of compensating an LDO wherein the LDO has an error amplifier coupled to a second amplifier. Step 602 of the flowchart 600 includes receiving a first voltage that is proportional to an output voltage of the LDO. Step 604 includes comparing the first voltage to a reference voltage using the error amplifier. Step 606 includes changing the gain of the error amplifier in response to comparing the first voltage to the reference voltage, wherein the change of gain provides gain boost to the output of the LDO. Step 608 includes changing the DC gain of the LDO in response to the comparing, wherein changing the gain reduces the difference between the first voltage and the reference voltage.

Although illustrative embodiments have been shown and described by way of example, a wide range of alternative embodiments is possible within the scope of the foregoing disclosure.

What is claimed:

1. A low dropout regulator (LDO) comprising:

an error amplifier having a first input and a second input, the first input for coupling to an output of the LDO and the second input for coupling to a reference voltage, the error amplifier operable to output a voltage proportional to the difference between the output voltage of the LDO and the reference voltage;

a second amplifier having an input coupled to the error amplifier and an output coupled to the output of the LDO;

a gain boost amplifier coupled between the output of the error amplifier and the input of the second amplifier, the gain boost amplifier operable to change the DC gain of the LDO in response to a load step on the output; and wherein the error amplifier comprises a differential amplifier having a tail current and wherein the tail current is set in response to the output of the error amplifier.

2. The LDO of claim 1, wherein the gain boost amplifier is further operable to reduce the DC gain of the error amplifier in response to the load step on the output of the LDO.

3. The LDO of claim 1, wherein the tail current is increased in response to the error amplifier indicating a difference between a voltage at the output of the LDO and the reference voltage, and wherein the tail current is decreased in response to the error amplifier indicating the voltage at the output of the LDO and the reference voltage being substantially the same.

4. The LDO of claim 1, wherein the error amplifier has a differential output coupled to the input of a differential amplifier, wherein the tail current is set in response to the output of the differential amplifier.

5. The LDO of claim 1, wherein the gain boost amplifier is operable to regulate current flow through the second amplifier.

6. The LDO of claim 1, wherein the gain boost amplifier is a differential amplifier, and further comprising a filter coupled between inputs of the differential amplifier.

7. The LDO of claim 1, further comprising a common gate amplifier coupled to the output of the error amplifier, the output of the common gate amplifier coupled to a transistor and is operable to control the tail current of the error amplifier.

8. A low dropout regulator (LDO) comprising:

an error amplifier having a first input and a second input, the first input for coupling to an output of the LDO and the second input for coupling to a reference voltage, the error amplifier operable to output a voltage proportional to the difference between the output voltage of the LDO and the reference voltage;

a second amplifier having an input coupled to the error amplifier and an output coupled to the output of the LDO;

a gain boost amplifier coupled between the output of the error amplifier and the input of the second amplifier, the gain boost amplifier operable to change the DC gain of the LDO in response to a load step on the output; and a pass transistor having a drain and source coupled between a voltage input to the LDO and the output of the LDO, the gate of the pass transistor being coupled to an input of the gain boost amplifier and an output of the second amplifier.

9. The LDO of claim 8, wherein the second amplifier is a differential amplifier, the gain boost amplifier is a differential amplifier, and wherein the gate of the pass transistor is coupled to a first output of the second amplifier and a first input of the gain boost amplifier.

10. The LDO of claim 9, wherein a second output of the second amplifier is coupled to a second input of the gain boost amplifier.

11. A method for compensating a low dropout regulator (LDO), the LDO having an error amplifier coupled to a second amplifier, the method comprising:

receiving a first voltage that is proportional to an output voltage of the LDO;

comparing the first voltage to a reference voltage using the error amplifier;

changing the gain of the error amplifier in response to comparing the first voltage to the reference voltage, wherein the change of gain provides gain boost to the output of the LDO; and changing the DC gain of the LDO in response to the comparing, wherein the changing the gain of the LDO reduces the difference between the first voltage and the reference voltage; and wherein the LDO comprises a differential amplifier having inputs coupled to the reference voltage and the first voltage, the differential amplifier operable to compare the first voltage to the reference voltage; wherein the differential amplifier has a tail current and wherein changing the gain of the error amplifier comprises changing the tail current.

12. The method of claim 11, wherein changing the tail current comprises:

increasing the tail current in response to the output voltage being different than the reference voltage; and decreasing the tail current in response to the output voltage being substantially the same as the reference voltage.

13. The method of claim 11, wherein the second amplifier has a current flow that is proportional to the gain of the second amplifier, and wherein changing the DC gain of the LDO in response to the comparing includes changing the current flow through the second amplifier.

14. A low dropout regulator (LDO) comprising:

an input for coupling to an input voltage;

an output for providing an output voltage;

a pass transistor coupled between the input and the output;

an error amplifier operable to compare the output voltage to a reference voltage and generate an error signal proportional to the difference between the output voltage and the reference voltage;

circuitry for controlling the gain of the error amplifier in response to the error signal;

a second amplifier having an output to the gate of the pass transistor;

a current regulator for controlling the gain of the second amplifier;

a gain boost amplifier coupled between the error amplifier and the second amplifier, the output of the gain boost amplifier for controlling the current regulator; and a filter coupled between differential inputs of the gain boost amplifier.

15. The LDO of claim 14, wherein the current regulator is a transistor having a gate coupled to the output of the gain boost amplifier.

16. A low dropout regulator (LDO) having an error amplifier and a gain boosting amplifier nested within the LDO, the LDO comprising:

an LDO input;

an LDO output, the error amplifier (EA) having a first EA input, a second EA input, a first EA output and a second EA output, the error amplifier including:

a first transistor having a first current terminal, a second current terminal connected to the first EA output, and a first control terminal connected to the first EA input; and a second transistor having a third current terminal connected to the first current terminal, a fourth current terminal connected to the second EA output, and a second control terminal connected to the LDO output;

a third transistor having a fifth current terminal, a sixth current terminal and a third control terminal connected to the fifth current terminal;

a pass transistor having a seventh current terminal connected to a first supply rail having a first supply potential, an eighth current terminal coupled to a second supply rail having a second supply potential different than the first supply potential, and a pass control terminal;

the gain boosting amplifier (GBA) having a first GBA input coupled to the third current terminal, a second GBA input coupled to the third current terminal and a GBA output, the gain boosting amplifier operable to cause a potential at the third control terminal to track a potential at the pass control terminal.

* * * * *